US008386256B2

(12) United States Patent
Raitio et al.

(10) Patent No.: US 8,386,256 B2
(45) Date of Patent: Feb. 26, 2013

(54) METHOD, APPARATUS AND COMPUTER PROGRAM PRODUCT FOR PROVIDING REAL GLOTTAL PULSES IN HMM-BASED TEXT-TO-SPEECH SYNTHESIS

(75) Inventors: Tuomo Johannes Raitio, Espoo (FI); Antti Santeri Suni, Helsinki (FI); Martti Tapani Vainio, Helsinki (FI); Paavo Ilmari Alku, Helsinki (FI); Jani Kristian Nurminen, Lempäälä (FI)

(73) Assignee: Nokia Corporation, Espoo (FI)

( * ) Notice: Subject to any disclaimer, the term of this patent is extended or adjusted under 35 U.S.C. 154(b) by 796 days.

(21) Appl. No.: 12/475,011

(22) Filed: May 29, 2009

(65) Prior Publication Data

US 2009/0299747 A1 Dec. 3, 2009

Related U.S. Application Data

(60) Provisional application No. 61/057,542, filed on May 30, 2008.

(51) Int. Cl.
*G10L 13/00* (2006.01)

(52) U.S. Cl. ..... 704/264

(58) Field of Classification Search ..... 704/264
See application file for complete search history.

(56) References Cited

U.S. PATENT DOCUMENTS 5,230,037 A * 7/1993 Giustiniani et al. ..... 704/200
5,400,434 A 3/1995 Pearson
5,450,522 A * 9/1995 Hermansky et al. ..... 704/200.1
5,528,726 A 6/1996 Cook
5,537,647 A * 7/1996 Hermansky et al. ..... 704/211
5,970,453 A * 10/1999 Sharman ..... 704/260
6,202,049 B1 * 3/2001 Kibre et al. ..... 704/267
7,617,188 B2 * 11/2009 Hu et al. ..... 1/1
7,953,751 B2 * 5/2011 Hu et al. ..... 707/769

FOREIGN PATENT DOCUMENTS

EP 1 005 021 B1 5/2000
EP 1 160 764 A1 12/2001

OTHER PUBLICATIONS

Office Action for Chinese Application No. 200980120201.2 dated Dec. 1, 2011.
Tokuda, K. et al., "An HMM-Based Speech Synthesis System Applied to English", *Proc. IEEE Workshop on Speech Synthesis*, 2002, pp. 227-230.
Yoshimura, T. et al., "Mixed Excitation for HMM-Based Speech Synthesis", *Proc. Eurospeech*, Sep. 2001, pp. 2259-2262.
Maia, R. et al., "An Excitation Model for HMM-Based Speech Synthesis Based on Residual Modeling", Sixth ISCA Workshop on Speech Synthesis, Aug. 2007, pp. 131-136.
Alku, P. et al., "A Method for Generating Natural-Sounding Speech Stimuli for Cognitive Brain Research", *Clinical Neurophysiology*, 1999, 110:1329-1333.

(Continued)

*Primary Examiner* — Susan McFadden
(74) *Attorney, Agent, or Firm* — Alston & Bird LLP

(57) ABSTRACT

An apparatus for providing improved speech synthesis may include a processor and a memory storing executable instructions. In response to execution of the instructions by the processor, the apparatus may perform at least selecting a real glottal pulse from among one or more stored real glottal pulses based at least in part on a property associated with the real glottal pulse, utilizing the real glottal pulse selected as a basis for generation of an excitation signal, and modifying the excitation signal based on spectral parameters generated by a model to provide synthetic speech.

17 Claims, 7 Drawing Sheets

OTHER PUBLICATIONS

Matsui , K. et al. *Improving Naturalness in Text-to-Speech Synthesis Using Natural Glottal Source*, Proceedings of the IEEE International Conference on Acoustics, Speech and Signal Processing (ICASSP' 1991), vol. 2, Apr. 1991, pp. 769-772.

Wu, Y. et al., *Minimum Generation Error Training For HMM-Based Speech Synthesis*, Proceedings of the IEEE International Conference on Acoustics, Speech and Signal Processing (ICASSP' 2006), vol. 1, May 2006, pp. 1-89 thru 1-92.

Written Opinion and International Search Report for PCT/FI2009/050414 dated Sep. 22, 2009.

Office Action for Korean Application No. 10-2010-7029463 dated Mar. 16, 2012.

Office Action from Chinese Patent Application No. 200980120201.2, dated Aug. 30, 2012.

Extened European Search Report/Written Opinion for Application No. 09 754 021 dated Dec. 21, 2012.

Fries, G., *Hybrid Time- and Frequency-Domain Speech Synthesis With Extended Glottal Source Generation*, Proceedings of the International Conference on Acoustics, Speech, and Signal Processing (ICASSP), vol. i, Apr. 19, 1994, pp. \1/581-1/584

Raitio, T., *Hidden Markov Model Based Finnish Text-to-Speech System Utilizing Glottal Inverse Filtering*, Master's Thesis Seminar, Helsinki University of Technology, May 14, 2008, 1-94 (slide pp. 1-45).

* cited by examiner

METHOD, APPARATUS AND COMPUTER PROGRAM PRODUCT FOR PROVIDING REAL GLOTTAL PULSES IN HMM-BASED TEXT-TO-SPEECH SYNTHESIS

CROSS REFERENCE TO RELATED APPLICATION

This application claims the benefit of U.S. Provisional Application No. 61/057,542, filed May 30, 2008, the contents of which are incorporated herein in their entirety.

TECHNOLOGICAL FIELD

Embodiments of the present invention relate generally to speech synthesis and, more particularly, relate to a method, apparatus, and computer program product for providing improved speech synthesis using a collection of glottal pulses.

BACKGROUND

The modern communications era has brought about a tremendous expansion of wireline and wireless networks. Computer networks, television networks, and telephony networks are experiencing an unprecedented technological expansion, fueled by consumer demand. Wireless and mobile networking technologies have addressed related consumer demands, while providing more flexibility and immediacy of information transfer.

Current and future networking technologies continue to facilitate ease of information transfer and convenience to users. One area in which there is a demand to increase ease of information transfer relates to the delivery of services to a user of a mobile terminal. The services may be in the form of a particular media or communication application desired by the user, such as a music player, a game player, an electronic book, short messages, email, etc. The services may also be in the form of interactive applications in which the user may respond to a network device in order to perform a task or achieve a goal. The services may be provided from a network server or other network device, or even from the mobile terminal such as, for example, a mobile telephone, a mobile television, a mobile gaming system, etc.

In many applications, it is necessary for the user to receive audio information such as oral feedback or instructions from the network or mobile terminal. An example of such an application may be paying a bill, ordering a program, receiving driving instructions, etc. Furthermore, in some services, such as audio books, for example, the application is based almost entirely on receiving audio information. It is becoming more common for such audio information to be provided by computer generated voices. Accordingly, the user's experience in using such applications will largely depend on the quality and naturalness of the computer generated voice. As a result, much research and development has gone into speech processing techniques in an effort to improve the quality and naturalness of computer generated voices.

Speech processing may generally include applications such as text-to-speech (TTS) conversion, speech coding, voice conversion, language identification, and numerous other like applications. In many speech processing applications, a computer generated voice, or synthetic speech, may be provided. In one particular example, TTS, which is the creation of audible speech from computer readable text, may be employed for speech processing including selection and concatenation of acoustical units. However, such forms of TTS often require very large amounts of stored speech data and are not adaptable to different speakers and/or speaking styles. In an alternative example, a hidden Markov model (HMM) approach may be employed in which smaller amounts of stored data may be employed for use in speech generation. However, current HMM systems often suffer from degraded naturalness in quality. In other words, many may consider that current HMM systems tend to oversimplify signal generation techniques and therefore do not properly mimic natural speech pressure waveforms.

Particularly in mobile environments, increases in memory consumption can directly affect the cost of devices employing such methods. Thus, HMM systems may be preferred in some cases due to the potential for speech synthesis with relatively fewer resource requirements. However, even in non-mobile environments, possible increases in application footprints and memory consumption may not be desirable. Accordingly, it may be desirable to develop an improved speech synthesis mechanism that may, for example, enable the provision of more natural sounding synthetic speech in an efficient manner.

BRIEF SUMMARY OF EXEMPLARY EMBODIMENTS

In one exemplary embodiment, a method of providing speech synthesis is provided. The method may include selecting a real glottal pulse from among one or more stored real glottal pulses based at least in part on a property associated with the real glottal pulse, utilizing the real glottal pulse selected as a basis for generation of an excitation signal, and modifying the excitation signal based on spectral parameters generated by a model to provide synthetic speech.

In another exemplary embodiment, a computer program product for providing speech synthesis is provided. The computer program product may include at least one computer-readable storage medium having computer-executable program code instructions stored therein. The computer-executable program code instructions may include program code instructions for selecting a real glottal pulse from among one or more stored real glottal pulses based at least in part on a property associated with the real glottal pulse, utilizing the real glottal pulse selected as a basis for generation of an excitation signal, and modifying the excitation signal based on spectral parameters generated by a model to provide synthetic speech.

In another exemplary embodiment, an apparatus for providing speech synthesis is provided. The apparatus may include a processor and a memory storing executable instructions. In response to execution of the instructions by the processor, the apparatus may perform at least selecting a real glottal pulse from among one or more stored real glottal pulses based at least in part on a property associated with the real glottal pulse, utilizing the real glottal pulse selected as a basis for generation of an excitation signal, and modifying the excitation signal based on spectral parameters generated by a model to provide synthetic speech.

BRIEF DESCRIPTION OF THE SEVERAL VIEWS OF THE DRAWING(S)

Having thus described embodiments of the invention in general terms, reference will now be made to the accompanying drawings, which are not necessarily drawn to scale, and wherein:

DETAILED DESCRIPTION

Figure 1:
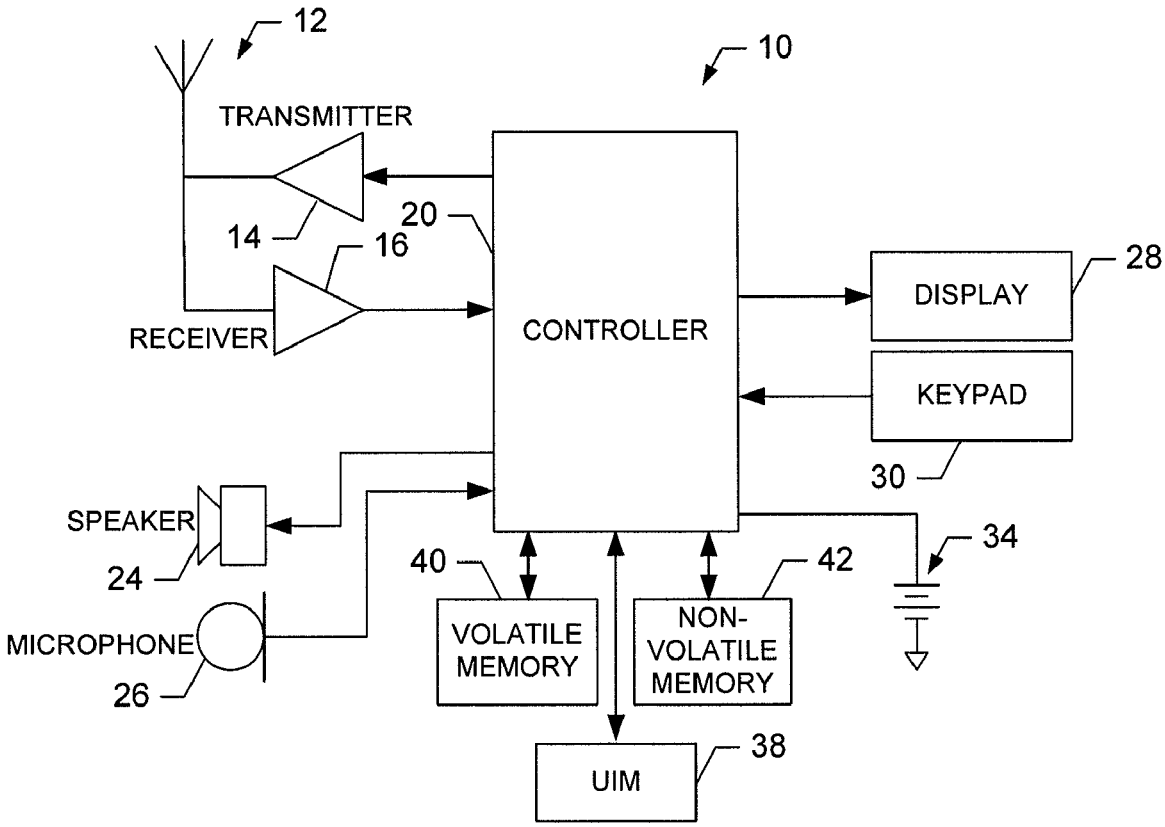
FIG. 1 is a schematic block diagram of a mobile terminal according to an exemplary embodiment of the present invention.

Embodiments of the present invention will now be described more fully hereinafter with reference to the accompanying drawings, in which some, but not all embodiments of the invention are shown. Indeed, embodiments of the invention may be embodied in many different forms and should not be construed as limited to the embodiments set forth herein; rather, these embodiments are provided so that this disclosure will satisfy applicable legal requirements. Like reference numerals refer to like elements throughout.

FIG. 1, one exemplary embodiment of the invention, illustrates a block diagram of a mobile terminal 10 that may benefit from embodiments of the present invention. It should be understood, however, that device as illustrated and hereinafter described is merely illustrative of one type of mobile terminal that would benefit from embodiments of the present invention and, therefore, should not be taken to limit the scope of embodiments of the present invention. While several embodiments of the mobile terminal 10 are illustrated and will be hereinafter described for purposes of example, other types of mobile terminals, such as portable digital assistants (PDAs), pagers, mobile televisions, gaming devices, all types of computers, cameras, mobile telephones, video recorders, audio/video player, radio, GPS devices, tablets, internet capable devices, or any combination of the aforementioned, and other types of communications systems, can readily employ embodiments of the present invention.

In addition, while several embodiments of the method of the present invention are performed or used by a mobile terminal 10, the method may be employed by other than a mobile terminal. Moreover, the system and method of embodiments of the present invention will be primarily described in conjunction with mobile communications applications. It should be understood, however, that the system and method of embodiments of the present invention can be utilized in conjunction with a variety of other applications, both in the mobile communications industries and outside of the mobile communications industries.

The mobile terminal 10 includes an antenna 12 (or multiple antennas) in operable communication with a transmitter 14 and a receiver 16. The mobile terminal 10 further includes an apparatus, such as a controller 20 or other processor, that provides signals to and receives signals from the transmitter 14 and receiver 16, respectively. The signals include signaling information in accordance with the air interface standard of the applicable cellular system, and also user speech, received data and/or user generated data. In this regard, the mobile terminal 10 is capable of operating with one or more air interface standards, communication protocols, modulation types, and access types. By way of illustration, the mobile terminal 10 is capable of operating in accordance with any of a number of first, second, third and/or fourth-generation communication protocols or the like. For example, the mobile terminal 10 may be capable of operating in accordance with second-generation (2G) wireless communication protocols IS-136 (time division multiple access (TDMA)), GSM (global system for mobile communication), and IS-95 (code division multiple access (CDMA)), or with third-generation (3G) wireless communication protocols, such as Universal Mobile Telecommunications System (UMTS), CDMA2000, wideband CDMA (WCDMA) and time division-synchronous CDMA (TD-SCDMA)), with 3.9G wireless communication protocol such as E-UTRAN (Evolved UMTS Terrestrial Radio Access Network), with fourth-generation (4G) wireless communication protocols or the like. As an alternative (or additionally), the mobile terminal 10 may be capable of operating in accordance with non-cellular communication mechanisms. For example, the mobile terminal 10 may be capable of communication in a wireless local area network (WLAN) or other communication networks described below in connection with FIG. 2.

It is understood that the apparatus such as the controller 20 includes circuitry desirable for implementing audio and logic functions of the mobile terminal 10. For example, the controller 20 may be comprised of a digital signal processor device, a microprocessor device, and various analog to digital converters, digital to analog converters, and other support circuits. Control and signal processing functions of the mobile terminal 10 are allocated between these devices according to their respective capabilities. The controller 20 thus may also include the functionality to convolutionally encode and interleave message and data prior to modulation and transmission. The controller 20 can additionally include an internal voice coder, and may include an internal data modem. Further, the controller 20 may include functionality to operate one or more software programs, which may be stored in memory. For example, the controller 20 may be capable of operating a connectivity program, such as a conventional Web browser. The connectivity program may then allow the mobile terminal 10 to transmit and receive Web content, such as location-based content and/or other web page content, according to a Wireless Application Protocol (WAP), Hypertext Transfer Protocol (HTTP) and/or the like, for example.

The mobile terminal 10 may also comprise a user interface including an output device such as a conventional earphone or speaker 24, a microphone 26, a display 28, and a user input interface, all of which are coupled to the controller 20. The user input interface, which allows the mobile terminal 10 to receive data, may include any of a number of devices allowing the mobile terminal 10 to receive data, such as a keypad 30, a touch display (not shown) or other input device. In embodiments including the keypad 30, the keypad 30 may include the conventional numeric (0-9) and related keys (#, *), and other hard and soft keys used for operating the mobile terminal 10. Alternatively, the keypad 30 may include a conventional QWERTY keypad arrangement. The keypad 30 may also include various soft keys with associated functions. In addition, or alternatively, the mobile terminal 10 may include an interface device such as a joystick or other user input interface. The mobile terminal 10 further includes a battery 34, such as a vibrating battery pack, for powering various circuits that are desired to operate the mobile terminal 10, as well as optionally providing mechanical vibration as a detectable output The mobile terminal 10 may further include a user identity module (UIM) 38. The UIM 38 is typically a memory device having a processor built in. The UIM 38 may include, for example, a subscriber identity module (SIM), a universal integrated circuit card (UICC), a universal subscriber identity module (USIM), a removable user identity module (R-UIM), etc. The UIM 38 typically stores information elements related to a mobile subscriber. In addition to the UIM 38, the mobile terminal 10 may be equipped with memory. For example, the mobile terminal 10 may include volatile memory 40, such as volatile Random Access Memory (RAM) including a cache area for the temporary storage of data. The mobile terminal 10 may also include other non-volatile memory 42, which can be embedded and/or may be removable. The non-volatile memory 42 can additionally or alternatively comprise an electrically erasable programmable read only memory (EEPROM), flash memory or the like, such as that available from the SanDisk Corporation of Sunnyvale, Calif., or Lexar Media Inc. of Fremont, Calif. The memories can store any of a number of pieces of information, and data, used by the mobile terminal 10 to implement the functions of the mobile terminal 10. For example, the memories can include an identifier, such as an international mobile equipment identification (IMEI) code, capable of uniquely identifying the mobile terminal 10. Furthermore, the memories may store instructions for determining cell id information. Specifically, the memories may store an application program for execution by the controller 20, which determines an identity of the current cell, i.e., cell id identity or cell id information, with which the mobile terminal 10 is in communication.

Figure 2:
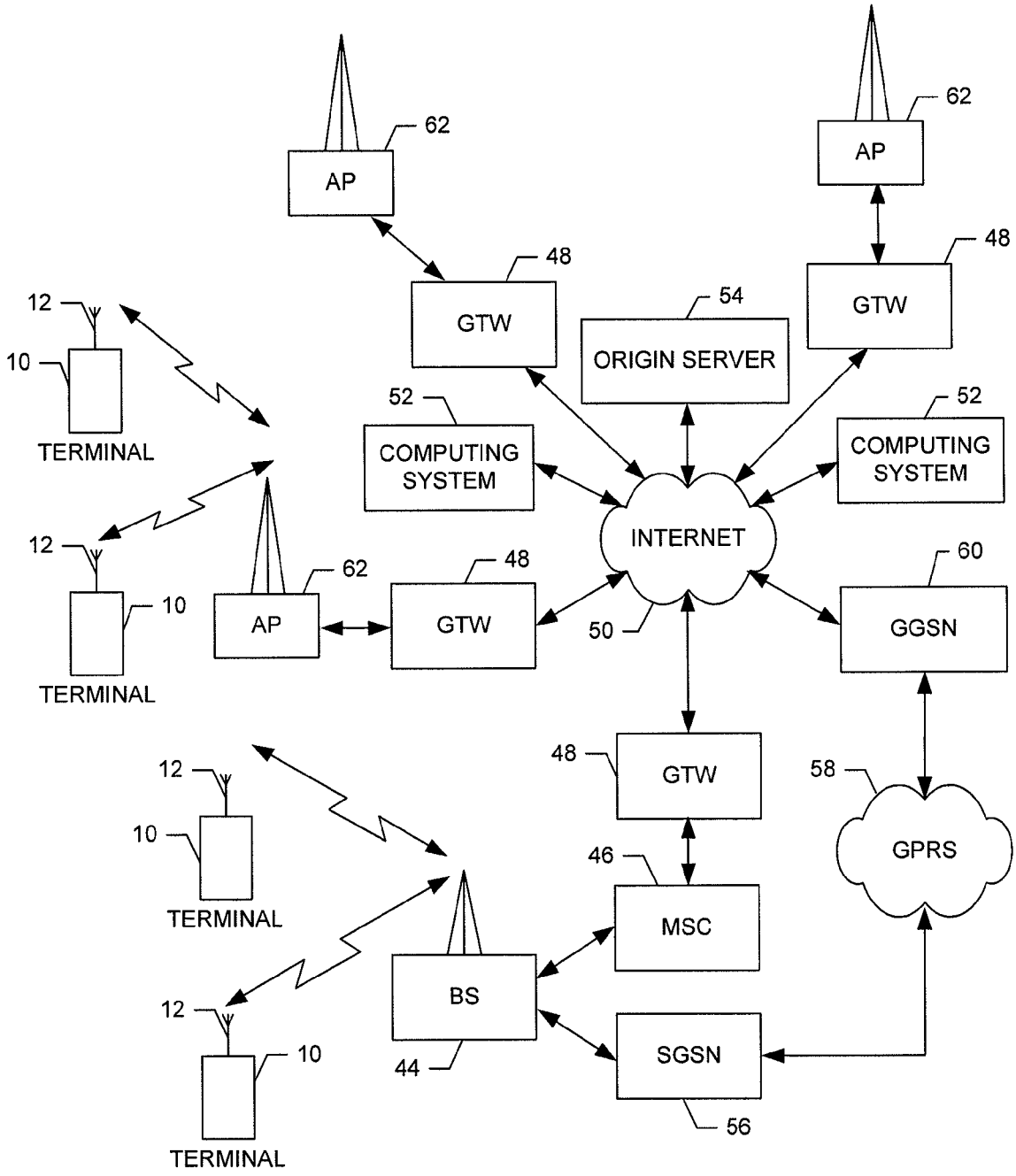
FIG. 2 is a schematic block diagram of a wireless communications system according to an exemplary embodiment of the present invention.

FIG. 2 is a schematic block diagram of a wireless communications system according to an exemplary embodiment of the present invention. Referring now to FIG. 2, an illustration of one type of system that would benefit from embodiments of the present invention is provided. The system includes a plurality of network devices. As shown, one or more mobile terminals 10 may each include an antenna 12 for transmitting signals to and for receiving signals from a base site or base station (BS) 44. The base station 44 may be a part of one or more cellular or mobile networks each of which includes elements desired to operate the network, such as a mobile switching center (MSC) 46. As well known to those skilled in the art, the mobile network may also be referred to as a Base Station/MSC/Interworking function (BMI). In operation, the MSC 46 is capable of routing calls to and from the mobile terminal 10 when the mobile terminal 10 is making and receiving calls. The MSC 46 can also provide a connection to landline trunks when the mobile terminal 10 is involved in a call. In addition, the MSC 46 can be capable of controlling the forwarding of messages to and from the mobile terminal 10, and can also control the forwarding of messages for the mobile terminal 10 to and from a messaging center. It should be noted that although the MSC 46 is shown in the system of FIG. 2, the MSC 46 is merely an exemplary network device and embodiments of the present invention are not limited to use in a network employing an MSC.

The MSC 46 can be coupled to a data network, such as a local area network (LAN), a metropolitan area network (MAN), and/or a wide area network (WAN). The MSC 46 can be directly coupled to the data network. In one embodiment, however, the MSC 46 is coupled to a gateway device (GTW) 48, and the GTW 48 is coupled to a WAN, such as the Internet 50. In turn, devices such as processing elements (e.g., personal computers, server computers or the like) can be coupled to the mobile terminal 10 via the Internet 50. For example, as explained below, the processing elements can include one or more processing elements associated with a computing system 52 (two shown in FIG. 2), origin server 54 (one shown in FIG. 2) or the like, as described below.

The BS 44 can also be coupled to a serving GPRS (General Packet Radio Service) support node (SGSN) 56. As known to those skilled in the art, the SGSN 56 is typically capable of performing functions similar to the MSC 46 for packet switched services. The SGSN 56, like the MSC 46, can be coupled to a data network, such as the Internet 50. The SGSN 56 can be directly coupled to the data network. In a more typical embodiment, however, the SGSN 56 is coupled to a packet-switched core network, such as a GPRS core network 58. The packet-switched core network is then coupled to another GTW 48, such as a gateway GPRS support node (GGSN) 60, and the GGSN 60 is coupled to the Internet 50. In addition to the GGSN 60, the packet-switched core network can also be coupled to a GTW 48. Also, the GGSN 60 can be coupled to a messaging center. In this regard, the GGSN 60 and the SGSN 56, like the MSC 46, may be capable of controlling the forwarding of messages, such as MMS messages. The GGSN 60 and SGSN 56 may also be capable of controlling the forwarding of messages for the mobile terminal 10 to and from the messaging center.

In addition, by coupling the SGSN 56 to the GPRS core network 58 and the GGSN 60, devices such as a computing system 52 and/or origin server 54 may be coupled to the mobile terminal 10 via the Internet 50, SGSN 56 and GGSN 60. In this regard, devices such as the computing system 52 and/or origin server 54 may communicate with the mobile terminal 10 across the SGSN 56, GPRS core network 58 and the GGSN 60. By directly or indirectly connecting mobile terminals 10 and the other devices (e.g., computing system 52, origin server 54, etc.) to the Internet 50, the mobile terminals 10 may communicate with the other devices and with one another, such as according to the Hypertext Transfer Protocol (HTTP) and/or the like, to thereby carry out various functions of the mobile terminals 10.

Although not every element of every possible mobile network is shown and described herein, it should be appreciated that the mobile terminal 10 may be coupled to one or more of any of a number of different networks through the BS 44. In this regard, the network(s) may be capable of supporting communication in accordance with any one or more of a number of first-generation (1G), second-generation (2G), 2.5G, third-generation (3G), 3.9G, fourth-generation (4G) mobile communication protocols or the like. For example, one or more of the network(s) can be capable of supporting communication in accordance with 2G wireless communication protocols IS-136 (TDMA), GSM, and IS-95 (CDMA). Also, for example, one or more of the network(s) can be capable of supporting communication in accordance with 2.5G wireless communication protocols GPRS, Enhanced Data GSM Environment (EDGE), or the like. Further, for example, one or more of the network(s) can be capable of supporting communication in accordance with 3G wireless communication protocols such as a UMTS network employing WCDMA radio access technology. Some narrow-band analog mobile phone service (NAMPS), as well as total access communication system (TACS), network(s) may also benefit from embodiments of the present invention, as should dual or higher mode mobile stations (e.g., digital/analog or TDMA/CDMA/analog phones).

The mobile terminal 10 can further be coupled to one or more wireless access points (APs) 62. The APs 62 may comprise access points configured to communicate with the mobile terminal 10 in accordance with techniques such as, for example, radio frequency (RF), infrared (IrDA) or any of a number of different wireless networking techniques, including wireless LAN (WLAN) techniques such as IEEE 802.11 (e.g., 802.11a, 802.11b, 802.11g, 802.11n, etc.), world interoperability for microwave access (WiMAX) techniques such as IEEE 802.16, and/or wireless Personal Area Network (WPAN) techniques such as IEEE 802.15, BlueTooth (BT), ultra wideband (UWB) and/or the like. The APs 62 may be coupled to the Internet 50. Like with the MSC 46, the APs 62 can be directly coupled to the Internet 50. In one embodiment, however, the APs 62 are indirectly coupled to the Internet 50 via a GTW 48. Furthermore, in one embodiment, the BS 44 may be considered as another AP 62. As will be appreciated, by directly or indirectly connecting the mobile terminals 10 and the computing system 52, the origin server 54, and/or any of a number of other devices, to the Internet 50, the mobile terminals 10 can communicate with one another, the computing system, etc., to thereby carry out various functions of the mobile terminals 10, such as to transmit data, content or the like to, and/or receive content, data or the like from, the computing system 52. As used herein, the terms "data," "content," "information" and similar terms may be used interchangeably to refer to data capable of being transmitted, received and/or stored in accordance with embodiments of the present invention. Thus, use of any such terms should not be taken to limit the spirit and scope of embodiments of the present invention.

Although not shown in FIG. 2, in addition to or in lieu of coupling the mobile terminal 10 to computing systems 52 across the Internet 50, the mobile terminal 10 and computing system 52 may be coupled to one another and communicate in accordance with, for example, RF, BT, IrDA or any of a number of different wireline or wireless communication techniques, including LAN, WLAN, WiMAX, UWB techniques and/or the like. One or more of the computing systems 52 can additionally, or alternatively, include a removable memory capable of storing content, which can thereafter be transferred to the mobile terminal 10. Further, the mobile terminal 10 can be coupled to one or more electronic devices, such as printers, digital projectors and/or other multimedia capturing, producing and/or storing devices (e.g., other terminals). Like with the computing systems 52, the mobile terminal 10 may be configured to communicate with the portable electronic devices in accordance with techniques such as, for example, RF, BT, IrDA or any of a number of different wireline or wireless communication techniques, including universal serial bus (USB), LAN, WLAN, WiMAX, UWB techniques and/or the like.

In an exemplary embodiment, content or data may be communicated over the system of FIG. 2 between a mobile terminal, which may be similar to the mobile terminal 10 of FIG. 1, and a network device of the system of FIG. 2 in order to, for example, execute applications or establish communication (e.g., for voice communication, receipt or provision of oral instructions, etc.) between the mobile terminal 10 and other mobile terminals or network devices. However, it should be understood that the system of FIG. 2 need not be employed for communication between mobile terminals or between a network device and the mobile terminal, but rather FIG. 2 is merely provided for purposes of example. Furthermore, it should be understood that embodiments of the present invention may be resident on a communication device such as the mobile terminal 10, and/or may be resident on other devices, absent any communication with the system of FIG. 2.

Figure 3:
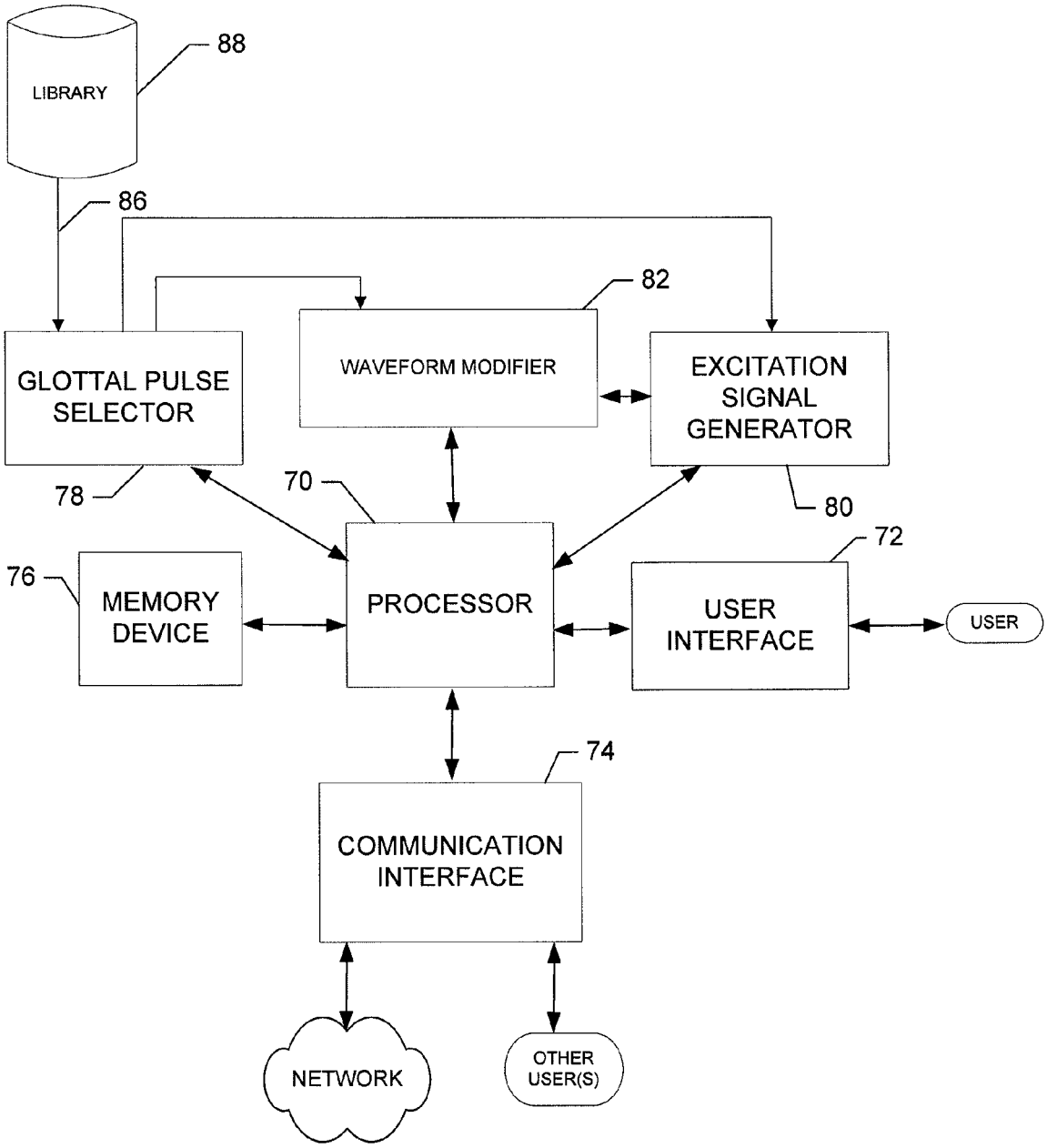
FIG. 3 illustrates a block diagram of portions of an apparatus for providing improved speech synthesis according to an exemplary embodiment of the present invention.

An exemplary embodiment of the invention will now be described with reference to FIG. 3, in which certain elements of an apparatus for providing improved speech synthesis are displayed. The apparatus of FIG. 3 may be employed, for example, on the mobile terminal 10 of FIG. 1 and/or the computing system 52 or the origin server 54 of FIG. 2. However, it should be noted that the system of FIG. 3, may also be employed on a variety of other devices, both mobile and fixed, and therefore, embodiments of the present invention should not be limited to application on devices such as the mobile terminal 10 of FIG. 1. Moreover, embodiments of the present invention may be physically located on multiple devices so that portions of the operations described herein are performed at one device and other portions are performed at another device (e.g., in a client/server relationship). It should also be noted, however, that while FIG. 3 illustrates one example of a configuration of an apparatus for providing improved speech synthesis, numerous other configurations may also be used to implement embodiments of the present invention. Furthermore, although FIG. 3 will be described in the context of one possible implementation involving a text-to-speech (TTS) conversion relating to hidden Markov model (HMM) based speech synthesis to illustrate an exemplary embodiment, embodiments of the present invention need not necessarily be practiced using the mentioned techniques, but instead other synthesis techniques could alternatively be employed. Thus, embodiments of the present invention may be practiced in exemplary applications such as, for example, in relation to speech synthesis in many different contexts.

HMM based speech synthesis has gained a lot of attention and popularity recently both in the research community and in commercial TTS development. In this regard, HMM based speech synthesis has been recognized as having several strengths (e.g. robustness, good trainability, small footprint, low sensitivity to bad instances in the training material). However, HMM based speech synthesis has also suffered from a somewhat robotic/artificial speech/voice quality in the opinion of many. The artificial and unnatural voice quality of HMM based speech synthesis may be at least in part attributed to inadequate techniques used in speech signal generation and the inadequate modeling of voice source characteristics.

In basic HMM based speech synthesis, the speech signal may be generated using a source-filter model in which the excitation signal may be modeled as a periodic impulse train (for voiced sounds) or white noise (for unvoiced sounds) to thereby provide a model (which may be considered relatively coarse) that results in the robotic or artificial speech quality mentioned above. Recently, mixed excitation and residual modeling techniques have been proposed to mitigate the problem described above. However, even though these techniques may provide improvements in speech quality, most continue to consider that the resultant speech quality remains relatively far from the quality of natural speech.

Glottal inverse filtering, which has heretofore been involved in studies limited to special purposes such as the generation of isolated vowels, may provide an opportunity for improving on existing techniques for speech synthesis. Glottal inverse filtering is a procedure in which a glottal source signal, the glottal volume velocity waveform, is estimated from a voiced speech signal. The usage of glottal inverse filtering in connection with speech synthesis is an aspect of an exemplary embodiment of the present invention as will be described in greater detail below. In particular, the incorporation of glottal inverse filtering for an exemplary HMM based speech synthesis will be described by way of example.

In an exemplary embodiment, one particular type of speech synthesis may be accomplished in the context of TTS. In this regard, for example, a TTS device may be utilized to provide a conversion between text and synthetic speech. TTS is the creation of audible speech from computer readable text and is often considered to include two stages. First, a computer examines the text to be converted to audible speech to determine specifications for how the text should be pronounced, what syllables to accent, what pitch to use, how fast to deliver the sound, etc. Next, the computer tries to create audio that matches the specifications. An exemplary embodiment of the present invention may be employed as a mechanism for generating the audible speech. In this regard, for example, the TTS device may determine properties in the text (e.g., emphasis, questions requiring inflection, tone of voice, or the like) via text analysis. These properties may be communicated to an HMM framework that may be used in connection with speech synthesis according to an exemplary embodiment. The HMM framework, which may be previously trained using modeled speech features from speech data in a database, may then be employed to generate parameters corresponding to the determined properties in the text. The parameters generated may then be used for the production of synthesized speech by, for example, an acoustic synthesizer configured to produce a synthetically created audio output in the form of computer generated speech.

Referring now to FIG. 3, an apparatus for providing speech synthesis is provided. The apparatus may include or otherwise be in communication with a processor 70, a user interface 72, a communication interface 74 and a memory device 76. The memory device 76 may include, for example, volatile and/or non-volatile memory (e.g., volatile memory 40 and non-volatile memory 42, respectively). The memory device 76 may be configured to store information, data, applications, instructions or the like for enabling the apparatus to carry out various functions in accordance with exemplary embodiments of the present invention. For example, the memory device 76 could be configured to buffer input data for processing by the processor 70. Additionally or alternatively, the memory device 76 could be configured to store instructions for execution by the processor 70. As yet another alternative, the memory device 76 may be one of a plurality of databases that store information such as speech or text samples or context dependent HMMs as described in greater detail below.

The processor 70 may be embodied in a number of different ways. For example, the processor 70 may be embodied as various processing means such as one or more processing elements, coprocessors, controllers or various other processing devices including integrated circuits such as, for example, an ASIC (application specific integrated circuit) or an FPGA (field programmable gate array). In an exemplary embodiment, the processor 70 may be configured to execute instructions stored in the memory device 76 or otherwise accessible to the processor 70. As such, whether configured by hardware or software methods, or by a combination thereof, the processor 70 may represent an entity (e.g., physically embodied in circuitry) capable of performing operations according to embodiments of the present invention while configured accordingly. Thus, for example, when the processor 70 is embodied as an ASIC, FPGA or the like, the processor 70 may be specifically configured hardware for conducting the operations described herein. Alternatively, as another example, when the processor 70 is embodied as an executor of software instructions, the instructions may specifically configure the processor 70 to perform the algorithms and/or operations described herein when the instructions are executed. However, in some cases, the processor 70 may be a processor of a specific device (e.g., a mobile terminal or network device) adapted for employing embodiments of the present invention by further configuration of the processor 70 by instructions for performing the algorithms and/or operations described herein.

Meanwhile, the communication interface 74 may be embodied as any device or means embodied in either hardware, software, or a combination of hardware and software that is configured to receive and/or transmit data from/to a network and/or any other device or module in communication with the apparatus. In this regard, the communication interface 74 may include, for example, an antenna and supporting hardware and/or software for enabling communications with a wireless communication network. In fixed environments, the communication interface 74 may alternatively or also support wired communication. As such, the communication interface 74 may include a communication modem and/or other hardware/software for supporting communication via cable, digital subscriber line (DSL), universal serial bus (USB) or other mechanisms.

The user interface 72 may be in communication with the processor 70 to receive an indication of a user input at the user interface 72 and/or to provide an audible, visual, mechanical or other output to the user. As such, the user interface 72 may include, for example, a keyboard, a mouse, a joystick, a touch screen display, a conventional display, a microphone, a speaker, or other input/output mechanisms. In an exemplary embodiment in which the apparatus is embodied as a server or some other network devices, the user interface 72 may be limited, or eliminated. However, in an embodiment in which the apparatus is embodied as a mobile terminal (e.g., the mobile terminal 10), the user interface 72 may include, among other devices or elements, any or all of the speaker 24, the microphone 26, the display 28, and the keyboard 30. In some embodiments in which the apparatus is embodied as a server or other network device, the user interface 72 may be limited or eliminated completely.

In an exemplary embodiment, the processor 70 may be embodied as, include or otherwise control a glottal pulse selector 78, an excitation signal generator 80, and/or a waveform modifier 82. The glottal pulse selector 78, the excitation signal generator 80, and the waveform modifier 82 may each be any means such as a device or circuitry operating in accordance with software or otherwise embodied in hardware or a combination of hardware and software (e.g., processor 70 operating under software control, the processor 70 embodied as an ASIC or FPGA specifically configured to perform the operations described herein, or a combination thereof) thereby configuring the device or circuitry to perform the corresponding functions of the glottal pulse selector 78, the excitation signal generator 80, and the waveform modifier 82, respectively, as described below.

In this regard, the glottal pulse selector 78 may be configured to access stored glottal pulse information 86 from a library 88 of glottal pulses. In an exemplary embodiment, the library 88 may actually be stored in the memory device 76. However, the library 88 could alternatively be stored at another location (e.g., a server or other network device) accessible to the glottal pulse selector 78. The library 88 may store glottal pulse information from one or a plurality of real or human speakers. The glottal pulse information stored, since it is derived from actual human speakers instead of synthetic sources, may be referred to as "real glottal pulse" information that corresponds to sound generated by vibration of a human larynx. However, the real glottal pulse information may include estimates of real glottal pulses since inverse filtering may not be a perfect process. As such, the term "real glottal pulse" should be understood to correspond to actual pulses or modeled or compressed pulses derived from real human speech. In an exemplary embodiment, the real speakers (or a single real speaker) may be chosen for inclusion in the library 88 such that the library 88 includes representative speech having various different fundamental frequency levels, various different phonation modes (e.g., normal, pressed and breathy) and/or natural variation or evolvement of adjacent glottal pulses in the real human voice production mechanism. The glottal pulses may be estimated from long vowel sounds of real human speakers using inverse glottal filtering.

In an exemplary embodiment, the library 88 may be populated by recording a long vowel sound with an increasing and/or decreasing fundamental frequency with different phonation modes. The corresponding glottal pulses may then be estimated using inverse filtering. Alternatively, other natural variations such as different intensities may be included. In this regard, however, as the number of included variations is increased, the size of the library 88 (and corresponding memory requirements) is also increased. Additionally, inclusion of a relatively large number of variations increases the challenge and complexity of synthesis. Accordingly, an amount of variations to be included in the library 88 may be balanced against the desires or capabilities that are present with respect to synthesis complexity and resource availability.

The glottal pulse selector 78 may be configured to select an appropriate glottal pulse to serve as the basis for signal generation for each fundamental frequency cycle. Thus, for example, several glottal pulses may be selected to serve as the basis for signal generation over a sentence comprising several fundamental frequency cycles. The selection made by the glottal pulse selector 78 may be handled based on different properties represented in the pulse library. For example, the selection may be handled based on the fundamental frequency level, type of phonation, etc. As such, for example, the glottal pulse selector 78 may select a glottal pulse or pulses that correspond to the properties associated with the text for which the respective pulse or pulses are meant to correlate. These properties may be indicated by labels associated with the text that may be generated during analysis of the text while the text is being processed for conversion to speech. In some embodiments, the selection made by the glottal pulse selector 78 may be partially (or even fully) dependent upon prior pulse selections in order to attempt to avoid changes in glottal excitation that may be unnatural or too abrupt. In other exemplary embodiments, random selection may be employed.

In an exemplary embodiment, the glottal pulse selector 78 may be a portion of, or in communication with, an HMM framework configured to facilitate the selection of glottal pulses as described above. In this regard, for example, the HMM framework may guide selection of glottal pulses (including the fundamental frequency and/or other properties in some cases) via parameters determined by the HMM framework as described in greater detail below.

After selection of the glottal pulses by the glottal pulse selector 78, a selected glottal pulse waveform may be used for generation of an excitation signal by the excitation signal generator 80. The excitation signal generator 80 may be configured to apply stored rules or models to an input from the glottal pulse selector 78 (e.g., a selected glottal pulse) to generate synthetic speech that audibly reproduces a signal based at least in part on the glottal pulse for communication to an audio mixer prior to delivery to another output device such as a speaker, or a voice conversion model.

In some embodiments, the selected glottal pulse may be modified prior to generation of the excitation signal by the excitation signal generator 80. In this regard, for example, if the desired fundamental frequency is not exactly available for selection (e.g., if the desired fundamental frequency is not stored in the library 88), the fundamental frequency level may be modified or adjusted by the waveform modifier 82. The waveform modifier 82 may be configured to modify fundamental frequency or other waveform characteristics using various different methods. For example, fundamental frequency modification can be implemented using time domain techniques, such as cubic spline interpolation, or may be implemented through a frequency domain representation. In some cases, modifications to the fundamental frequency may be made by changing the period of the corresponding glottal flow pulse using some specifically designed technique that, for example, may treat different parts of the pulse (e.g. the opening or closing part) differently.

If more than one pulse was chosen, the selected pulses can be weighted and combined into a single pulse waveform using time or frequency domain techniques. An example of such a situation is given by a case where the library includes appropriate pulses at fundamental frequency levels of 100 Hz and 130 Hz, but the desired fundamental frequency is 115 Hz. Accordingly, both pulses (e.g., the pulses at the 100 Hz and 130 Hz levels) may be chosen and both pulses may then be combined into a single pulse after fundamental frequency modification. As a result, smooth changes in the waveform may be experienced when the fundamental frequency level is changing as both the cycle duration and pulse shape are smoothly or gradually adjusted from cycle to cycle.

A challenge that may be experienced in the selection of a glottal pulse may be that natural variations in a glottal waveform may be desirable for allowance even when the fundamental frequency level is constant. Thus, according to some embodiments, a repeat of the same glottal pulse may be avoided in relation to the excitation for consecutive cycles. One solution for this challenge may be to include several consecutive pulses in the library 88 either at the same or different fundamental frequency levels. The selection can then avoid repeating the same pulse by operating on a range of pulses around the correct fundamental frequency level and by selecting the next acceptable pulse (such as one that naturally follows the previous selection). The pattern can be circularly repeated and the fundamental frequency levels can be adjusted based on the desired fundamental frequency as a post processing step by the waveform modifier 82. When the fundamental frequency level changes the selection range can be updated accordingly.

The generation of a glottal pulse waveform using the library 88 and the above techniques described in connection with the glottal pulse selector 78, the excitation signal generator 80, and the waveform modifier 82 may provide a glottal excitation that behaves quite similarly as compared to real glottal volume velocity waveforms in natural (human) speech production. The generated glottal excitation can also be further processed using other techniques. For example, the breathiness can be adjusted by adding noise to certain frequencies. After any optional post processing steps, which may also be performed by the waveform modifier 82 in some embodiments, the synthesis process can be continued by matching the spectral content with the desired voice source spectrum and by generating synthetic speech.

Depending on the implementation environment, pulse waveforms can be stored as such or compressed using a known compression or modeling technique. From the viewpoint of speech quality and naturalness, the creation of the pulse library and the optimization of the selection and post processing steps described above may improve speech synthesis in a TTS or other speech synthesis system.

Figure 4:
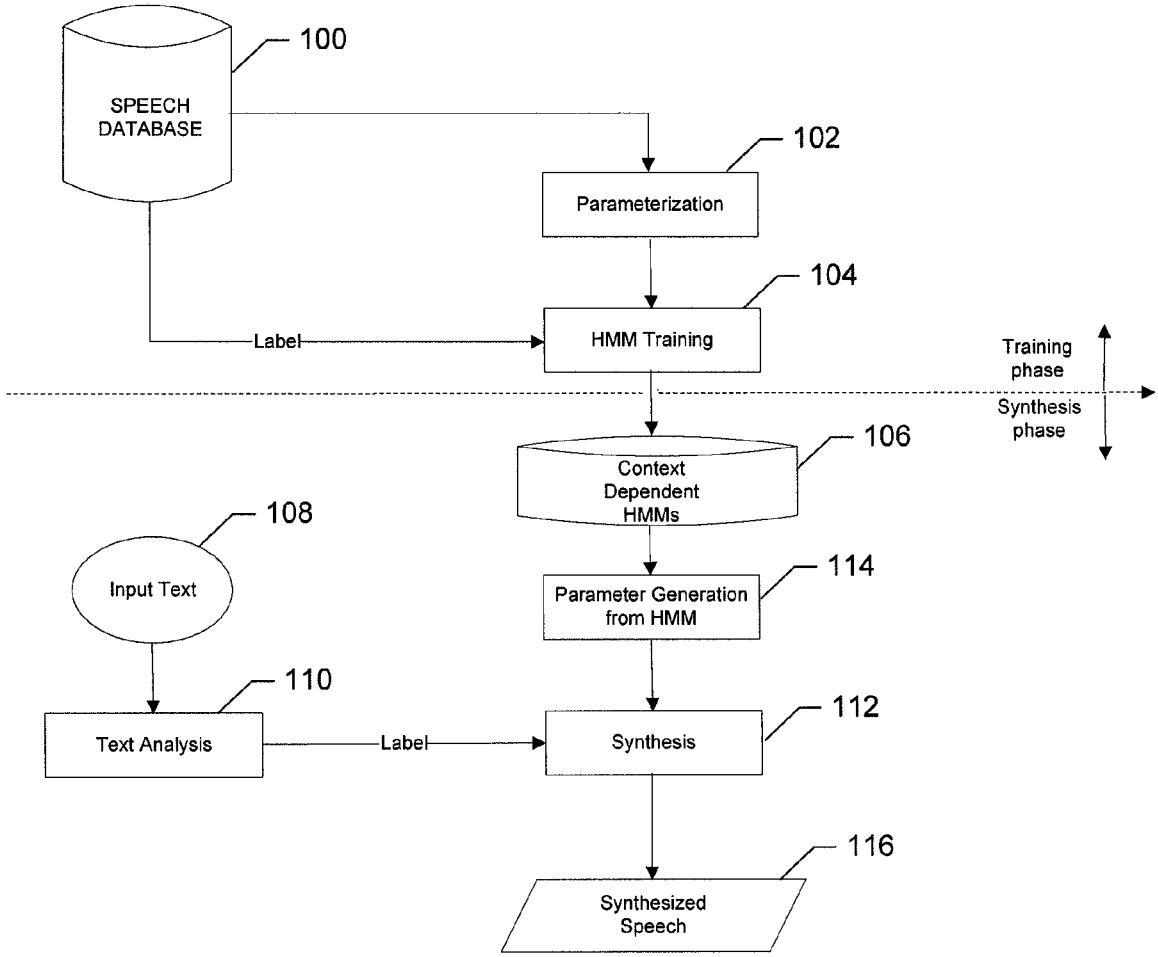
FIG. 4 is a block diagram according to an exemplary system for improved speech synthesis according to an exemplary embodiment of the present invention.

FIG. 4 illustrates an example of a speech synthesis system that may benefit from embodiments of the present invention. The system includes of two major parts that operate in separate phases: training and synthesis. In the training part, speech parameters computed by glottal inverse filtering may be extracted from sentences of a speech database 100 during a parameterization operation 102. The parameterization operation 102 may, in some instances, compress information from a speech signal to a few parameters that describe the essential characteristics of the speech signal accurately. However, in alternative embodiments, the parameterization operation 102 may actually include a level of detail that makes the parameterization of the same size or even a larger size as compared to the original speech. One way to conduct the parameterization operation may be to separate the speech signal into a source signal and filter coefficients that do not correspond to the real glottal flow and the vocal tract filter. However, with this kind of simplified models it is difficult to model the real mechanisms of human speech production. Thus, in the exemplary embodiments discussed further in this document, a more accurate parameterization is used to better model the human speech production and in particular the voice source. In addition, an HMM framework is used for speech modeling.

In this regard, as shown in FIG. 4, the obtained speech parameters from the parameterization operation 102 may be used for HMM training at operation 104 in order to model an HMM framework for use in the synthesis phase. In the synthesis part, the HMM framework, which may include modeled HMMs, may be employed for speech synthesis. In this regard, for example, context dependent (trained) HMMs may be stored for use at operation 106 in speech synthesis. Input text 108 may be subjected to text analysis at operation 110 and information (e.g., labels) regarding properties of the analyzed text may be communicated to a synthesis module 112. The HMMs may be concatenated according to the analyzed input text and speech parameters may be generated at operation 114 from the HMMs. The parameters generated may then be fed into the synthesis module 112 for use in speech synthesis at operation 116 for creating a speech waveform.

Figure 5:
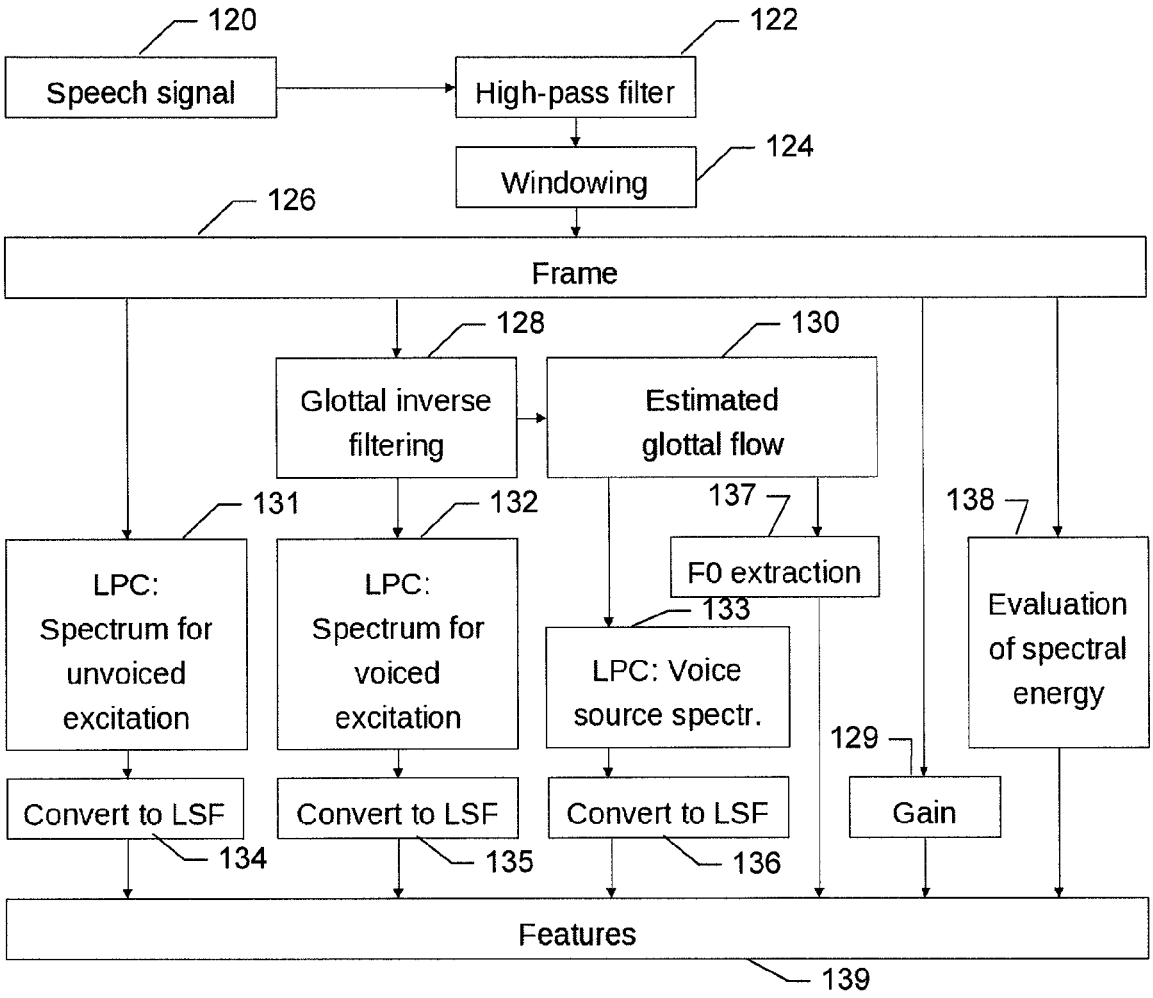
FIG. 5 illustrates an example of parameterization operations according to an exemplary embodiment of the present invention.

The parameterization operation 102 may be conducted in numerous manners. FIG. 5 illustrates an example of parameterization operations according to an exemplary embodiment of the present invention. In an exemplary embodiment, a speech signal 120 may be filtered (e.g., via a high pass filter 122 for removing distorting low-frequency fluctuations) and windowed with a rectangular window 124 to a predetermined size of frame at a predetermined interval (e.g., as shown by frame 126). The mean of each frame may be removed in order to zero DC components in each frame. Parameters may then be extracted from each frame. Glottal inverse filtering (e.g., as shown at operation 128) may estimate glottal volume velocity waveforms for each speech pressure signal. In an exemplary embodiment, the iterative adaptive inverse filtering technique may be employed as an automatic inverse filtering method by iteratively canceling the effects of vocal tract and lip radiation from the speech signal using adaptive all-pole modeling. LPC models (e.g., models 131, 132 and 133) may be provided for unvoiced excitation, voiced excitation and voice source, respectively. All obtained models may then be converted to LSFs (e.g., as shown in blocks 134, 135 and 136, respectively).

The parameters can be divided into source and filter parameters, as indicated above. For creating the voice source, fundamental frequency, energy, spectral energy, and voice source spectrum may be extracted. For creating the formant structure corresponding to the vocal tract filtering effect, spectra for voiced and unvoiced speech sounds may be extracted. In this regard, fundamental frequency may be extracted from the estimated glottal flow at block 137 and an evaluation of spectral energy may be performed at block 138. Features 139 corresponding to the speech signal may then be obtained after gain adjustment (e.g., at block 129). Separate spectra for voiced and unvoiced excitation may be extracted since the vocal tract transfer function yielded by glottal inverse filtering does not, as such, represent an appropriate spectral envelope for unvoiced speech sounds. Outputs of the glottal inverse filtering may include an estimated glottal flow 130 and a model of the vocal tract (e.g., an LPC (linear predictive coding) model).

After the parameterization operation 102, the obtained speech features may be modeled simultaneously in a unified framework. All parameters excluding the fundamental frequency may be modeled with continuous density HMMs by single Gaussian distributions with diagonal covariance matrices. The fundamental frequency may be modeled by a multi-space probability distribution. State durations for each phoneme HMM may be modeled with multi-dimensional Gaussian distributions.

After training of monophone HMMs, various contextual factors are taken into account and the monophone models are converted into context dependent models. As the number of the contextual factors increases, their combinations also increase exponentially. Due to the limited amount of training data, model parameters may not be capable of estimation with sufficient accuracy in some cases. To overcome this problem, the models for each feature may be clustered independently by using a decision-tree based context clustering technique. The clustering may also enable generation of synthesis parameters for new observation vectors that are not included in the training material.

During synthesis, the model created in the training part may be used for generating speech parameters according to input text 108. The parameters may then be fed into the synthesis module 112 for generating the speech waveform. In an exemplary embodiment, in order to generate speech parameters according to the input text 108, first, a phonological and high-level linguistic analysis is performed at the text analysis operation 110. During operation 110, the input text 108 may be converted to a context-based label sequence. According to the label sequence and decision trees generated by the training stage, a sentence HMM may be constructed by concatenating context dependent HMMs. State durations of the sentence HMM may be determined so as to maximize the likelihood of the state duration densities. According to the obtained sentence HMM and state durations, a sequence of speech features may be generated by using a speech parameter generation algorithm.

Figure 6:
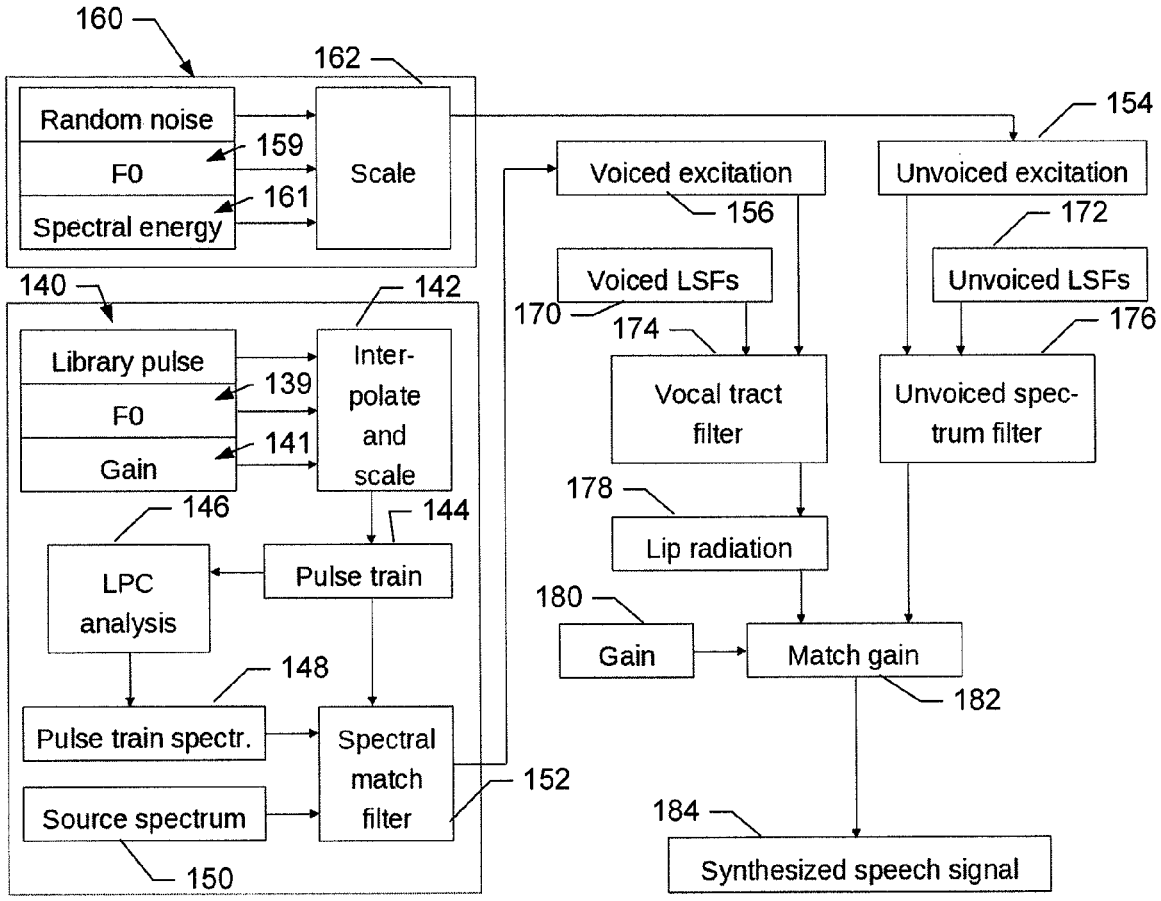
FIG. 6 illustrates an example of synthesis operations according to an exemplary embodiment of the present invention.

The analyzed text and speech parameters generated may be used by the synthesis module 112 for speech synthesis. FIG. 6 illustrates an example of synthesis operations according to an exemplary embodiment. The synthesized speech may be generated using an excitation signal including voiced and unvoiced sound sources. A natural glottal flow pulse may be used (e.g., from the library 88) as a library pulse for creating the voice source. In comparison to artificial glottal flow pulses, the use of natural glottal flow pulses may assist in preserving the naturalness and quality of the synthetic speech. The library pulse, as described above (and shown in block 140 of FIG. 6), may have been extracted from an inverse filtered frame of a sustained natural vowel produced by a particular speaker. A particular fundamental frequency (e.g., F0 at block 139) and gain 141 may be associated with the library pulse.

The glottal flow pulse may be modified in the time domain in order to remove resonances that may be present due to imperfect glottal inverse filtering. The beginning and the end of the pulse may also be set to the same level (e.g., zero) by subtracting a linear gradient from the pulse.

By selecting and modifying real glottal flow pulses (e.g., via interpolation and scaling 142), a pulse train 144 comprising a series of individual glottal pulses with varying period lengths and energies may be generated. As discussed above, a cubic spline interpolation technique, or other suitable mechanism, may be used for making the glottal flow pulses longer or shorter in order to change the fundamental frequency of the voice source.

In an exemplary embodiment, in order to mimic the natural variations in the voice source, a desired voice source all-pole spectrum generated by the HMM may be applied to the pulse train (e.g., as indicated at blocks 148 and 150). This may be achieved by first evaluating the LPC spectrum of the generated pulse train (e.g., as shown at block 146) and then filtering the pulse train with an adaptive IIR (infinite impulse response) filter which may flatten the spectrum of the pulse train and apply the desired spectrum. In this regard, the LPC spectrum of the generated pulse train may be evaluated by fitting an integer number of the modified library pulses to the frame, and performing the LPC analysis without windowing. Before the reconstruction of this filter (e.g., spectral match filter 152), the LPC spectrum of the generated pulse train may be converted to LSFs (line spectral frequencies), and both LSFs may then be interpolated on a frame by frame basis (e.g., with cubic spline interpolation), and then converted back to linear prediction coefficients.

The unvoiced sound source may be represented by white noise. In order to incorporate an unvoiced component also when the speech sounds are voiced (e.g. breathy sounds), both voiced and unvoiced streams may be produced concurrently throughout the frame. During unvoiced speech sounds, the unvoiced excitation 154 may be the primary sound source, but during voiced speech sounds, the unvoiced excitation may be much lower in intensity. The unvoiced excitation of white noise (e.g., as indicated at block 160) may be controlled by the fundamental frequency value (e.g., F0 shown at block 159 in FIG. 6) and further weighted according to the energies of corresponding frequency bands (e.g., as indicated at block 161). The result may be scaled as shown at block 162. In some embodiments, in order to make the incorporated noise component in voiced speech segments sound more natural, the noise component may be modulated according to the glottal flow pulses. However, if the modulation is too intensive, the resulting speech may sound unnatural.

A formant enhancement procedure may then be applied to the LSFs of voiced and unvoiced spectrum generated by the HMM to compensate for averaging effects associated with statistical modeling. After formant enhancement, the voiced and unvoiced LSFs (e.g., 170 and 172, respectively) generated by the HMM may be interpolated on a frame by frame basis (e.g., with cubic spline interpolation). LSFs may then be converted to linear prediction coefficients, and used for filtering the excitation signals (e.g., as shown at blocks 174 and 176). For voiced excitation 156, a lip radiation effect may be modeled as well (e.g., as shown at block 178. The gain of the combined signals (voiced and unvoiced contributions) may then be matched according to an energy measure generated by the HMM (e.g., as shown at blocks 180 and 182) to produce a synthesized speech signal 184.

Embodiments of the present invention may provide improvements to quality as compared to conventional approaches by providing a more natural speech quality in HMM based synthetic speech generation. Some embodiments may also provide a relatively close relation to the real human voice production mechanism without adding a high degree of complexity. In some cases, separate natural voice source and vocal tract characteristics are fully available for modeling. Accordingly, embodiments may provide improved quality with respect to alterations of speaking style, speaker characteristics and emotion. In addition, some embodiments may offer good trainability and robustness on a relatively small footprint.

Figure 7:
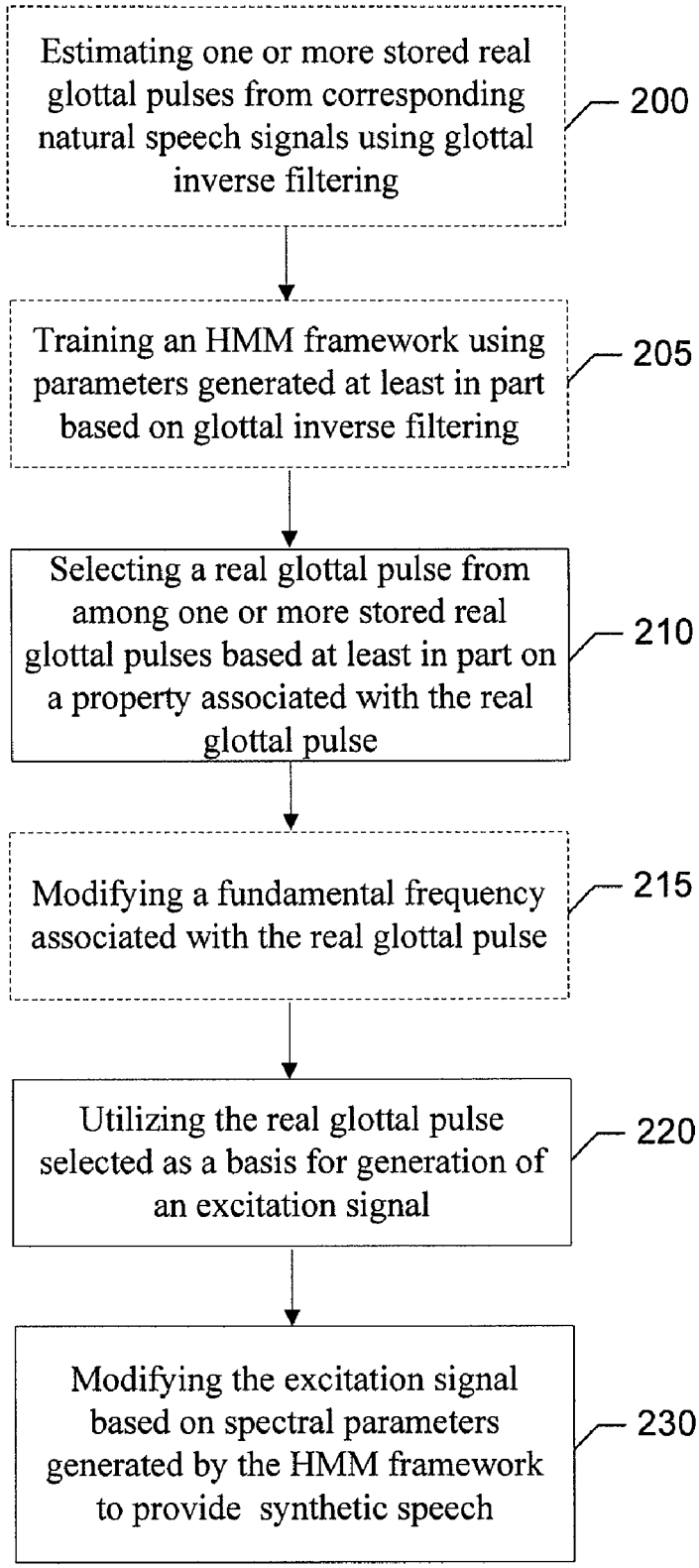
FIG. 7 is a block diagram according to an exemplary method for providing improved speech synthesis according to an exemplary embodiment of the present invention.

FIG. 7 is a flowchart of a system, method and program product according to exemplary embodiments of the invention. It will be understood that each block or step of the flowchart, and combinations of blocks in the flowchart, may be implemented by various means, such as hardware, firmware, processor, circuitry and/or other devices including a computer program product having a computer readable medium storing software including one or more computer program instructions. For example, one or more of the procedures described above may be embodied by computer program instructions. In this regard, the computer program instructions which embody the procedures described above may be stored by a memory device (e.g., of the mobile terminal or other device) and executed by a processor (e.g., in the mobile terminal or another device). As will be appreciated, any such computer program instructions may be loaded onto a computer or other programmable apparatus (e.g., hardware) to produce a machine, such that the resulting computer or other programmable apparatus embodies means for implementing the functions specified in the flowcharts block(s) or step(s). These computer program instructions may also be stored in a computer-readable memory that can direct a computer or other programmable apparatus to function in a particular manner, such that the instructions stored in the computer-readable memory produce an article of manufacture including instruction means which implement the function specified in the flowchart's block(s) or step(s). The computer program instructions may also be loaded onto a computer or other programmable apparatus to cause a series of operational steps to be performed on the computer or other programmable apparatus to produce a computer-implemented process such that the instructions which execute on the computer or other programmable apparatus provide steps for implementing the functions specified in the flowchart's block(s) or step(s).

Accordingly, blocks or steps of the flowchart support combinations of means for performing the specified functions, combinations of steps for performing the specified functions and program instruction means for performing the specified functions. It will also be understood that one or more blocks or steps of the flowchart, and combinations of blocks or steps in the flowcharts, can be implemented by special purpose hardware-based computer systems which perform the specified functions or steps, or combinations of special purpose hardware and computer instructions.

In this regard, one embodiment of a method for providing improved speech synthesis as provided in FIG. 7 may include selecting a real glottal pulse from among one or more stored real glottal pulses based at least in part on a property associated with the real glottal pulse at operation 210. The method may further include utilizing the real glottal pulse selected as a basis for generation of an excitation signal at operation 220 and modifying (e.g., filtering) the excitation signal based on spectral parameters generated by a model to provide synthetic speech or a component of synthetic speech at operation 230. Other means of processing the pulses may also be used, e.g. the breathiness can be adjusted by adding noise to the correct frequencies.

In an exemplary embodiment, the method may further include other operations that may be optional. As such, FIG. 7 illustrates some exemplary additional operations that are shown in dashed lines. In this regard, for example, the method may include an initial operation of estimating the plurality of stored real glottal pulses from corresponding natural speech signals using glottal inverse filtering at operation 200. In some embodiments, the model may include an HMM framework and thus, the method may include training the HMM framework using parameters generated at least in part based on glottal inverse filtering at operation 205. In other alternative embodiments, selection of the real glottal pulse may be made at least in part based on a fundamental frequency associated with the real glottal pulse. In such embodiments, the method may include modifying the fundamental frequency at operation 215.

In cases where the fundamental frequency is modified, such modification may be performed by utilizing time domain or frequency techniques for modifying the fundamental frequency. In an exemplary embodiment, selecting the real glottal pulse may include selecting at least two pulses and modifying the fundamental frequency may include combining the at least two pulses into a single pulse. In alternative embodiments, selecting the real glottal pulse may further include selecting the real glottal pulse at least in part based on parameters associated with the HMM framework or selecting a current pulse based at least in part on a previously selected pulse.

In an exemplary embodiment, an apparatus for performing the method above may include a processor (e.g., the processor 70) configured to perform each of the operations (200-230) described above. The processor may, for example, be configured to perform the operations by executing stored instructions or an algorithm for performing each of the operations. Alternatively, the apparatus may include means for performing each of the operations described above. In this regard, according to an exemplary embodiment, examples of means for performing operations 200 to 230 may include, for example, a computer program product implementing an algorithm for managing speech synthesis operations as described above, corresponding ones of the glottal pulse selector 78, the excitation signal generator 80, and the waveform modifier 82, the processor 70, or the like.

A method, apparatus and computer program product are therefore provided to enable improved speech synthesis. In particular, a method, apparatus and computer program product are provided that may enable speech synthesis using stored glottal pulse information in HMM based speech synthesis. As such, for example, a library of real glottal pulses may be created and utilized for HMM based speech synthesis.

In one exemplary embodiment, a method of providing improved speech synthesis is provided. The method may include selecting a real glottal pulse from among a plurality of stored real glottal pulses based at least in part on a property associated with the real glottal pulse, utilizing the real glottal pulse selected as a basis for generation of an excitation signal, and modifying the excitation signal based on spectral parameters generated by a model to provide synthetic speech. In some cases, the method may further include other operations that may be optional such as estimating the plurality of stored real glottal pulses from corresponding natural speech signals using glottal inverse filtering. In some embodiments, the model may include an HMM framework and thus, the method may include training the HMM framework using parameters generated at least in part based on glottal inverse filtering. In other alternative embodiments, selection of the real glottal pulse may be made at least in part based on a fundamental frequency associated with the real glottal pulse. In such embodiments, the method may include modifying the fundamental frequency. In cases where the fundamental frequency is modified, such modification may be performed by utilizing time domain or frequency techniques for modifying the fundamental frequency. In an exemplary embodiment, selecting the real glottal pulse may include selecting at least two pulses and modifying the fundamental frequency may include combining the at least two pulses into a single pulse. In alternative embodiments, selecting the real glottal pulse may further include selecting the real glottal pulse at least in part based on parameters associated with the HMM framework or selecting a current pulse based at least in part on a previously selected pulse.

In another exemplary embodiment, a computer program product for providing improved speech synthesis is provided. The computer program product includes at least one computer-readable storage medium having computer-executable program code portions stored therein. The computer-executable program code portions may include first, second and third program code portions. The first program code portion is for selecting a real glottal pulse from among a plurality of stored real glottal pulses based at least in part on a property associated with the real glottal pulse. The second program code portion is for utilizing the real glottal pulse selected as a basis for generation of an excitation signal. The third program code portion is for modifying the excitation signal based on spectral parameters generated by a model to provide synthetic speech. In some cases, the computer program product may further include other program code portions that may be optional such as a program code portion for estimating the plurality of stored real glottal pulses from corresponding natural speech signals using glottal inverse filtering. In some embodiments, the model may include an HMM framework and thus, the computer program product may include a program code portion for training the HMM framework using parameters generated at least in part based on glottal inverse filtering. In other alternative embodiments, selection of the real glottal pulse may be made at least in part based on a fundamental frequency associated with the real glottal pulse. In such embodiments, the computer program product may include a program code portion for modifying the fundamental frequency. In cases where the fundamental frequency is modified, such modification may be performed by utilizing time domain or frequency techniques for modifying the fundamental frequency. In an exemplary embodiment, selecting the real glottal pulse may include selecting at least two pulses and modifying the fundamental frequency may include combining the at least two pulses into a single pulse. In alternative embodiments, selecting the real glottal pulse may further include selecting the real glottal pulse at least in part based on parameters associated with the HMM framework or selecting a current pulse based at least in part on a previously selected pulse.

In another exemplary embodiment, an apparatus for providing improved speech synthesis is provided. The apparatus may include a processor. The processor may be configured to select a real glottal pulse from among a plurality of stored real glottal pulses based at least in part on a property associated with the real glottal pulse, utilize the real glottal pulse selected as a basis for generation of an excitation signal, and modify the excitation signal based on spectral parameters generated by a model to provide synthetic speech. In some cases, the processor may be further configured to perform operations that may be optional such as estimating the plurality of stored real glottal pulses from corresponding natural speech signals using glottal inverse filtering. In some embodiments, the model may include an HMM framework and thus, the processor may train the HMM framework using parameters generated at least in part based on glottal inverse filtering. In other alternative embodiments, selection of the real glottal pulse may be made at least in part based on a fundamental frequency associated with the real glottal pulse. In such embodiments, the processor may be configured to modify the fundamental frequency. In cases where the fundamental frequency is modified, such modification may be performed by utilizing time domain or frequency techniques for modifying the fundamental frequency. In an exemplary embodiment, selecting the real glottal pulse may include selecting at least two pulses and modifying the fundamental frequency may include combining the at least two pulses into a single pulse. In alternative embodiments, selecting the real glottal pulse may further include selecting the real glottal pulse at least in part based on parameters associated with the HMM framework or selecting a current pulse based at least in part on a previously selected pulse.

In another exemplary embodiment, an apparatus for providing improved speech synthesis is provided. The apparatus may include means for selecting a real glottal pulse from among a plurality of stored real glottal pulses based at least in part on a property associated with the real glottal pulse, means for utilizing the real glottal pulse selected as a basis for generation of an excitation signal, and means for modifying the excitation signal based on spectral parameters generated by a model to provide synthetic speech. In such an embodiment, means for modifying the excitation signal based on spectral parameters generated by the model may include means for modifying the excitation signal based on spectral parameters generated by a hidden Markov model framework.

Embodiments of the invention may provide a method, apparatus and computer program product for advantageous employment in a speech processing. As a result, for example, users of mobile terminals or other speech processing devices may enjoy enhanced usability and improved speech processing capabilities without appreciably increasing memory and footprint requirements for the mobile terminal.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

What is claimed is:

1. An apparatus comprising:

a processor; and a memory including computer program code, the memory and the computer program code configured to, with the processor, cause the apparatus to at least:

select a real glottal pulse from among one or more stored real glottal pulses based at least in part on a property associated with the real glottal pulse;

utilize the real glottal pulse selected as a basis for generation of an excitation signal; and modify the excitation signal based on spectral parameters generated by a model to provide synthetic speech and by filtering the excitation signal based on spectral parameters generated by a hidden Markov model framework.

2. An apparatus according to claim 1, wherein the memory including the computer program code is further configured to, with the processor, cause the apparatus to perform an initial operation of estimating the plurality of stored real glottal pulses from corresponding natural speech signals using glottal inverse filtering.

3. An apparatus according to claim 1, wherein the memory including the computer program code is further configured to, with the processor, cause the apparatus to train the hidden Markov model framework using parameters generated at least in part based on glottal inverse filtering.

4. An apparatus according to claim 1, wherein the memory including the computer program code is further configured to, with the processor, cause the apparatus to select the real glottal pulse by selecting the real glottal pulse at least in part based on parameters associated with the hidden Markov model framework.

5. An apparatus according to claim 1, wherein the memory including the computer program code is further configured to, with the processor, cause the apparatus to select the real glottal pulse by selecting a current pulse based at least in part on a previously selected pulse.

6. An apparatus according to claim 1, wherein the memory including the computer program code is further configured to, with the processor, cause the apparatus to select the real glottal pulse by selecting the real glottal pulse based on a fundamental frequency associated with the real glottal pulse.

7. An apparatus according to claim 6, wherein the memory including the computer program code is further configured to, with the processor, cause the apparatus to modify the fundamental frequency.

8. An apparatus according to claim 7, wherein the memory including the computer program code is further configured to, with the processor, cause the apparatus to modify the fundamental frequency by utilizing time domain or frequency techniques for modifying the fundamental frequency.

9. An apparatus according to claim 6, wherein the memory including the computer program code is further configured to, with the processor, cause the apparatus to select the real glottal pulse by selecting at least two pulses and wherein modifying the fundamental frequency comprises combining the at least two pulses into a single pulse.

10. A method comprising:

selecting a real glottal pulse from among one or more stored real glottal pulses based at least in part on a property associated with the real glottal pulse;

utilizing the real glottal pulse selected as a basis for generation of an excitation signal; and modifying, via a processor, the excitation signal based on spectral parameters generated by a model to provide synthetic speech and spectral parameters generated by a hidden Markov model framework.

11. A method according to claim 10, wherein selecting the real glottal pulse further comprises selecting a current pulse based at least in part on a previously selected pulse.

12. A method according to claim 10, wherein selecting the real glottal pulse further comprises selecting the real glottal pulse based on a fundamental frequency associated with the real glottal pulse.

13. A method according to claim 10, further comprising an initial operation of estimating the plurality of stored real glottal pulses from corresponding natural speech signals using glottal inverse filtering.

14. A computer program product comprising at least one computer-readable non-transitory storage medium having computer-executable program code portions stored therein, the computer-executable program code portions comprising:

program code instructions for selecting a real glottal pulse from among one or more stored real glottal pulses based at least in part on a property associated with the real glottal pulse;

program code instructions for utilizing the real glottal pulse selected as a basis for generation of an excitation signal; and program code instructions for modifying the excitation signal based on spectral parameters generated by a model to provide synthetic speech and spectral parameters generated by a hidden Markov model framework.

15. A computer program product according to claim 14, wherein the program code instructions for selecting the real glottal pulse include instructions for selecting a current pulse based at least in part on a previously selected pulse.

16. A computer program product according to claim 14, wherein the program code instructions for selecting the real glottal pulse include instructions for selecting the real glottal pulse based on a fundamental frequency associated with the real glottal pulse.

17. A computer program product according to claim 14, further comprising program code instructions for an initial operation of estimating the plurality of stored real glottal pulses from corresponding natural speech signals using glottal inverse filtering.

* * * * *